US007045211B2

(12) United States Patent
Fairbanks et al.

(10) Patent No.: US 7,045,211 B2
(45) Date of Patent: May 16, 2006

(54) CRIMPED THERMOPLASTIC MULTICOMPONENT FIBER AND FIBER WEBS AND METHOD OF MAKING

(75) Inventors: Jason S. Fairbanks, Gainesville, GA (US); Frank P. Abuto, Duluth, GA (US); Stephen F. Borengasser, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/631,144

(22) Filed: Jul. 31, 2003

(65) Prior Publication Data

US 2005/0025964 A1 Feb. 3, 2005

(51) Int. Cl.
*D01F 8/00* (2006.01)

(52) U.S. Cl. ..... 428/370; 428/373; 428/374

(58) Field of Classification Search ..... 428/370, 428/373, 374

See application file for complete search history.

(56) References Cited

U.S. PATENT DOCUMENTS

| | | | | |
|---|---|---|---|---|
| 3,423,266 | A | 1/1969 | Davies et al. | 156/167 |
| 3,595,731 | A | 7/1971 | Davies et al. | 428/151 |
| 3,657,062 | A * | 4/1972 | Eshima et al. | 428/374 |
| 3,692,618 | A | 9/1972 | Dorschner et al. | 442/401 |
| 3,802,817 | A | 4/1974 | Matsuki et al. | 428/66 |
| 3,849,241 | A | 11/1974 | Butin et al. | 428/137 |
| 3,855,046 | A | 12/1974 | Hansen et al. | 428/198 |
| 3,969,559 | A * | 7/1976 | Boe | 428/87 |
| 4,041,203 | A | 8/1977 | Brock et al. | 428/157 |
| 4,198,459 | A | 4/1980 | Brumlik | 442/189 |
| 4,340,563 | A | 7/1982 | Appel et al. | 264/518 |
| 4,488,928 | A | 12/1984 | Ali Khan et al. | 156/495 |
| 4,704,116 | A | 11/1987 | Enloe | 604/385.27 |
| 5,108,820 | A | 4/1992 | Kaneko et al. | 428/198 |
| 5,318,650 | A | 6/1994 | Kerawalla | |
| 5,336,552 | A | 8/1994 | Strack et al. | 442/361 |
| 5,382,400 | A | 1/1995 | Pike et al. | 264/168 |
| 5,384,082 | A | 1/1995 | Frankfort et al. | 264/103 |
| 5,418,045 | A * | 5/1995 | Pike et al. | 428/198 |
| 5,597,645 | A | 1/1997 | Pike et al. | 96/99 |
| 5,679,042 | A | 10/1997 | Varona | 442/347 |
| 5,721,180 | A * | 2/1998 | Pike et al. | 442/346 |
| 5,853,881 | A | 12/1998 | Estey et al. | 428/373 |
| 5,873,968 | A * | 2/1999 | Pike et al. | 156/73.2 |
| 5,876,840 | A | 3/1999 | Ning et al. | 428/198 |
| 5,899,785 | A | 5/1999 | Groten et al. | |
| 5,989,004 | A | 11/1999 | Cook | 425/131.5 |
| 6,159,881 | A | 12/2000 | Datta et al. | 442/409 |
| 6,162,535 | A * | 12/2000 | Turkevich et al. | 428/372 |

(Continued)

FOREIGN PATENT DOCUMENTS

| | | |
|---|---|---|
| WO | WO 01/88234 | 11/2001 |

(Continued)

OTHER PUBLICATIONS

Textile Dictionary, p. 32,date 1989.*

*Primary Examiner*—N Edwards
(74) *Attorney, Agent, or Firm*—Robert A. Ambrose

(57) ABSTRACT

The present invention provides a crimped multicomponent fiber containing at least two polymer components arranged in a crimpable configuration in distinct zones or segments across the cross-section of the fiber wherein one component comprises a dielectrically susceptible material. The invention also provides methods for producing the crimped multicomponent fibers and for forming web materials containing the crimped multicomponent fibers, and provides absorbent articles comprising the crimped multicomponent fibers and web materials.

6 Claims, 5 Drawing Sheets

U.S. PATENT DOCUMENTS

| | | | | |
|---|---|---|---|---|
| 6,309,736 | B1 | 10/2001 | McCormack et al. | 428/198 |
| 6,410,138 | B1 * | 6/2002 | Mleziva et al. | 428/369 |
| 6,506,873 | B1 * | 1/2003 | Ryan et al. | 528/354 |
| 6,527,834 | B1 * | 3/2003 | Jorder et al. | 96/68 |
| 6,548,429 | B1 * | 4/2003 | Lintecum et al. | 442/199 |
| 6,589,392 | B1 * | 7/2003 | Skinner et al. | 162/348 |
| 6,710,242 | B1 * | 3/2004 | Iguro et al. | 174/36 |
| 2002/0074697 | A1 | 6/2002 | Steinke et al. | |
| 2002/0098764 | A1 | 7/2002 | Mleziva et al. | |

FOREIGN PATENT DOCUMENTS

| | | |
|---|---|---|
| WO | WO 01/88235 | 11/2001 |
| WO | WO 03/54258 | 7/2003 |
| WO | WO 03/054268 | 7/2003 |
| WO | WO 03/055674 | 7/2003 |

* cited by examiner

CRIMPED THERMOPLASTIC MULTICOMPONENT FIBER AND FIBER WEBS AND METHOD OF MAKING

TECHNICAL FIELD

The present invention is related to crimped multicomponent thermoplastic fibers and to web materials made from such crimped fibers, and a method for making the fibers and web materials.

BACKGROUND OF THE INVENTION

Many of the medical care garments and products, protective wear garments, mortuary and veterinary products, and personal care products in use today are partially or wholly constructed of nonwoven materials. Examples of such products include, but are not limited to, medical and health care products such as surgical drapes, gowns and bandages, protective workwear garments such as coveralls and lab coats, and infant, child and adult personal care absorbent articles such as diapers, training pants, disposable swimwear, incontinence garments and pads, sanitary napkins, wipes and the like. For these applications nonwoven fibrous webs provide functional, tactile, comfort and aesthetic properties which can approach or even exceed those of traditional woven or knitted cloth materials. Nonwoven materials are also widely utilized as filtration media for both liquid and gas or air filtration applications since they can be formed into a lofty filter mesh of fibers having a low average pore size suitable for trapping particulate matter while still having a low pressure drop across the mesh.

The characteristics or physical properties of nonwoven web materials are controlled, at least in part, by the density or openness of the fabric. The web density can be controlled to a great deal by the fiber structure and, in particular, by the curl or crimp of a fiber along its length. Generally speaking, nonwoven webs made from crimped fibers have a lower density, higher loft and improved resiliency compared to similar nonwoven webs of uncrimped fibers. Such lofty, low density webs exhibit cloth-like textural properties, e.g., softness, drapability and hand. Various methods of crimping melt-spun multicomponent fibers are known in the art. As disclosed in U.S. Pat. Nos. 3,595,731 and 3,423,266 to Davies et al., bicomponent fibers may be mechanically crimped and the resultant fibers formed into a nonwoven web or, if the appropriate polymers are used, a latent helical crimp produced in bicomponent fibers may be activated by heat treatment of the formed web. Alternatively, the methods disclosed in U.S. Pat. No. 5,382,400 to Pike et al., may be used to produce crimp in the fibers by using the differential rates of expansion and contraction of the two (or more) polymers to produce latent helical crimp in the fibers, and using a heat treatment to activate the latent helical crimp in the fibers before the fibers have been formed into a nonwoven web. In addition, U.S. Pat. No. 5,876,840 to Ning et al. teaches spunbond multicomponent fibers having a non-ionic surfactant additive within one of the components in order to accelerate its solidification rate. By adding the non-ionic surfactant to one of the components of the multicomponent fiber it is possible to develop and activate a latent crimp by drawing with unheated air.

Notwithstanding the foregoing, there is a continuing need for crimped multicomponent fibers and nonwoven fabrics made therefrom having desirable physical attributes or properties such as softness, resiliency, strength, high porosity and overall uniformity.

SUMMARY OF THE INVENTION

The present invention provides for a method of making a crimped thermoplastic multicomponent fiber including the steps of extruding a multicomponent fiber from a thermoplastic melt in a crimpable cross-sectional configuration such as, for example, an eccentric sheath-core configuration or a side-by-side configuration. The multicomponent fiber includes at least a first thermoplastic component and a second thermoplastic component, wherein the first component includes a dielectrically susceptible material, and then quenching the fiber, attenuating the fiber to form a substantially uncrimped fiber, and subjecting the fiber to a dielectric energy field to activate crimp. In addition, a plurality of these fibers may be formed and collected on a moving surface to form a nonwoven web. The step of subjecting the fiber or fibers to dielectric energy may be performed before or after the fibers are collected on the moving surface. The nonwoven web of multicomponent fibers formed thereby may be bonded, and the nonwoven web may be subjected to dielectric energy after being bonded. The thermoplastic components may desirably be polyolefin polymers and the first thermoplastic component may desirably comprise a dielectrically susceptible additive material such as carbon black, ferrite, tin oxide, silicon carbide, calcium chloride, zircon, magnetite, silicon carbide, calcium chloride, alumina, magnesium oxide, or titanium dioxide in an amount from about 5% to about 40% by weight of the of the first component.

The invention also provides for a method of making a nonwoven web comprising crimped thermoplastic staple length fibers, including the steps of forming multicomponent staple length fibers into a nonwoven web, where the staple length fibers comprise at least first and second thermoplastic components which are arranged in a crimpable cross-sectional configuration, and the first component includes a dielectrically susceptive material, and the step of subjecting the staple length fibers to a dielectric energy field to activate crimp. The nonwoven web may then be bonded by, for example, thermal point bonding, through air bonding, adhesive bonding or entanglement bonding. The step of subjecting the fibers to dielectric energy may occur before the fibers are formed into a nonwoven web, after the fibers are formed into a nonwoven web, or after bonding the nonwoven web. The nonwoven web may further comprise secondary fibers such as for example cellulosic fibers and thermoplastic staple length fibers, and in some embodiments at least some of the crimped thermoplastic multicomponent staple length fibers wrap around at least some of the secondary fibers when the crimped is activated.

The invention further provides for a crimped thermoplastic multicomponent fiber having first and second thermoplastic components which are arranged in a crimpable cross-sectional configuration, where the first thermoplastic component includes a dielectrically susceptible material. The crimpable cross-sectional configuration may be an eccentric sheath-core configuration or a side-by-side configuration, and the first thermoplastic component may desirably comprise a dielectrically susceptible additive material such as carbon black, ferrite, tin oxide, silicon carbide, calcium chloride, zircon, magnetite, silicon carbide, calcium chloride, alumina, magnesium oxide, or titanium dioxide, the additive in an amount from about 5% to about 40% by weight of the of the first component. Alternatively, the first component may comprise a dielectrically susceptible polymer such as nylons or copolyesters. In still further embodiments, a nonwoven web comprising a plurality of the crimped thermoplastic multicomponent fibers is provided, and the nonwoven web may further comprise secondary fibers, and in some embodiments at least some of the crimped thermoplastic multicomponent fibers are wrapped around at least some of the secondary fibers. The nonwoven webs may also comprise superabsorbent materials, and the nonwoven webs with or without secondary fibers or superabsorbent materials may be used as components of absorbent articles.

DEFINITIONS

Figure 1A:
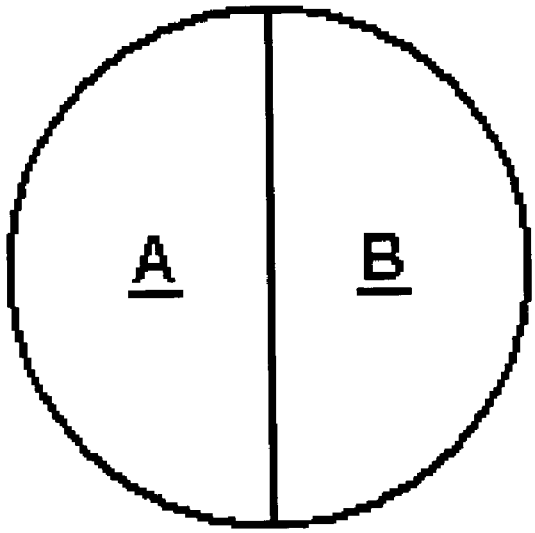
FIGS. 1A and 1B illustrate examples of multicomponent fiber configurations suitable for the present invention.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries. As used herein the term "thermoplastic" or "thermoplastic polymer" refers to polymers which will soften and flow or melt when heat and/or pressure are applied, the changes being reversible.

As used herein the term "fibers" refers to both staple length fibers and substantially continuous filaments, unless otherwise indicated. As used herein the term "substantially continuous" with respect to a filament or fiber means a filament or fiber having a length much greater than its diameter, for example having a length to diameter ratio in excess of about 15,000 to 1, and desirably in excess of 50,000 to 1.

As used herein the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc.

As used herein the term "multicomponent fibers" refers to fibers which have been formed from at least two component polymers, or the same polymer with different properties or additives, extruded from separate extruders but spun together to form one fiber. Multicomponent fibers are also sometimes referred to as conjugate fibers or bicomponent fibers, although more than two components may be used. The polymers are arranged in substantially constantly positioned distinct zones across the cross-section of the multicomponent fibers and extend continuously along the length of the multicomponent fibers. The configuration of such a multicomponent fiber may be, for example, a concentric or eccentric sheath/core arrangement wherein one polymer is surrounded by another, or may be a side by side arrangement, an "islands-in-the-sea" arrangement, or arranged as pie-wedge shapes or as stripes on a round, oval or rectangular cross-section fiber, or other. Multicomponent fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios. In addition, any given component of a multicomponent fiber may desirably comprise two or more polymers as a multiconstituent blend component.

As used herein the term "biconstituent fiber" or "multiconstituent fiber" refers to a fiber formed from at least two polymers, or the same polymer with different properties or additives, extruded from the same extruder as a blend. Multiconstituent fibers do not have the polymer components arranged in substantially constantly positioned distinct zones across the cross-section of the multicomponent fibers; the polymer components may form fibrils or protofibrils which start and end at random.

As used herein, the term "crimp" means a three-dimensional curl or crimp such as, for example, a helical crimp and does not include random two-dimensional waves or undulations in a fiber.

As used herein, the term "dielectrically susceptible" material means a material such as a polymer, or an additive to a polymer, which is receptive to and capable of being heated by a dielectric energy field such as a radio frequency energy field or microwave energy.

As used herein the term "nonwoven web" or "nonwoven fabric" means a web having a structure of individual fibers or filaments which are interlaid, but not in an identifiable manner as in a knitted or woven fabric. Nonwoven fabrics or webs have been formed from many processes such as for example, meltblowing processes, spunbonding processes, airlaying processes, and carded web processes. The basis weight of nonwoven fabrics is usually expressed in grams per square meter (gsm) or ounces of material per square yard (osy) and the fiber diameters useful are usually expressed in microns. (Note that to convert from osy to gsm, multiply osy by 33.91).

The term "spunbond" or "spunbond fiber nonwoven fabric" refers to a nonwoven fiber fabric of small diameter fibers that are formed by extruding molten thermoplastic polymer as fibers from a plurality of capillaries of a spinneret. The extruded fibers are cooled while being drawn by an eductive or other well known drawing mechanism. The drawn fibers are deposited or laid onto a forming surface in a generally random, isotropic manner to form a loosely entangled fiber web, and then the laid fiber web is subjected to a bonding process to impart physical integrity and dimensional stability. The production of spunbond fabrics is disclosed, for example, in U.S. Pat. No. 4,340,563 to Appel et al., U.S. Pat. No. 3,802,817 to Matsuki et al. and U.S. Pat. No. 3,692,618 to Dorschner et al. Typically, spunbond fibers have a weight-per-unit-length of less than about 2 denier and up to about 6 denier, although finer and heavier spunbond fibers can be produced. In terms of fiber diameter, spunbond fibers may range from about 10 to about 30 microns and more particularly from about 15 to about 25 microns.

As used herein the term "meltblown fibers" means fibers formed by extruding a molten thermoplastic material through a plurality of fine, usually circular, die capillaries as molten threads or fibers into converging high velocity gas (e.g. air) streams which attenuate the fibers of molten thermoplastic material to reduce their diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers may be continuous or discontinuous, are generally smaller than 10 microns in diameter, and are generally tacky when deposited onto a collecting surface.

The term "staple fibers" or "staple length fibers" refers to discontinuous fibers, which typically have an average diameter similar to that of spunbond fibers. Staple fibers may be produced with conventional fiber spinning processes and then cut to a staple length, typically from about ¼ inch (about 0.6 cm) or smaller to about 8 inches (about 20 cm). Such staple fibers may be subsequently carded or airlaid and thermally or adhesively bonded to form a nonwoven fabric.

As used herein "carded webs" refers to nonwoven webs formed by carding processes as are known to those skilled in the art and further described, for example, in coassigned U.S. Pat. No. 4,488,928 to Alikhan and Schmidt which is incorporated herein in its entirety by reference. Briefly, carding processes involve starting with staple fibers in a bulky batt that is combed or otherwise treated to provide a generally uniform basis weight. A carded web may then be bonded by conventional means as are known in the art such as for example through air bonding, ultrasonic bonding and thermal point bonding.

As used herein, an "airlaid" web is a fibrous web structure formed primarily by a process involving deposition of loose, air-entrained fibers onto a porous or foraminous forming surface. Generally the web comprises cellulosic fibers such as those from fluff pulp that have been separated from a mat of fibers, such as by a hammermilling process, and then entrained in a moving stream of air and deposited or collected on the forming screen or other foraminous forming surface, usually with the assistance of a vacuum supply, in order to form a dry-laid fiber web. There may also be other fibers such as thermoplastic staple fibers or binder fibers present, and typically following collection of the fibers on the forming surface the web is densified and/or bonded by such means as thermal bonding or adhesive bonding. In addition, super absorbent materials in particulate or fiber form may be included in airlaid webs where desired. Equipment for producing air-laid webs includes the Rando-Weber air-former machine available from Rando Corporation of New York and the Dan-Web rotary screen air-former machine available from Dan-Web Forming of Risskov, Denmark.

As used herein, the term "cellulosic" is meant to include materials having cellulose as a major constituent, and specifically comprising at least 50 percent by weight cellulose or a cellulose derivative. Therefore the term cellulosic includes, without limitation, cotton, typical wood pulps, non-woody cellulosic fibers, cellulose acetate, cellulose triacetate, rayon, thermomechanical wood pulp, chemical wood pulp, debonded chemical wood pulp, milkweed, or bacterial cellulose.

As used herein, "thermal point bonding" involves passing a fabric or web of fibers or other sheet layer material to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch (about 31 bonds/square cm) as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Other common patterns include a diamond pattern with repeating and slightly offset diamonds and a wire weave pattern looking as the name suggests, e.g. like a woven window screen. Typically, the percent bonding area varies from around 10% to around 30% of the area of the fabric laminate web. Thermal point bonding imparts integrity to individual layers by bonding fibers within the layer and/or for laminates, point bonding holds the layers together to form a cohesive laminate.

DETAILED DESCRIPTION OF THE INVENTION

The present invention provides crimped multicomponent fibers and a method for producing the same. The invention additionally provides nonwoven webs or fabrics containing the crimped multicomponent fibers. The multicomponent fibers can be characterized in that the fiber contains at least first and second thermoplastic polymer components which are arranged in distinct segments in a crimpable configuration across the cross-section of the fiber along the length of the fiber, wherein the first polymer component includes a dielectrically susceptible material. Depending on the embodiment, the multicomponent fiber component including the dielectrically susceptible material may provided as a dielectrically susceptible polymer component, a blend of a dielectrically susceptible polymer with a non-dielectrically susceptible polymer, and/or be a non-dielectrically susceptible polymer which has a dielectrically susceptible additive material added to it. In the practice of the invention more than one component of the multicomponent fiber may comprise dielectrically susceptible materials and/or polymers, but in order to facilitate crimp formation one component should always be substantially more susceptible than the other. While not wishing to be bound by any particular theory, we believe the maximum crimping effect can be achieved in the situation where one component is dielectrically susceptible and the other component is largely transparent to dielectric energy, that is, substantially non-receptive or only minimally receptive to dielectric energy.

The multicomponent fibers may have various cross-sectional configurations or geometric arrangements depending on the embodiment. However, the components should be arranged in a crimpable configuration. Suitable configurations of this type include the side-by-side configuration such as in FIG. 1A and the eccentric sheath-and-core configuration as in FIG. 1B. Other crimpable configurations are known, such as for example lobed or other non-round cross-sectional configurations, such as "Tri-T", "H" and "X" shaped configurations as are known in the art (not shown). It should be noted that although these figures may depict multicomponent fiber configurations wherein individual components occupy approximately equal portions of the cross sectional area of the entire fiber, they need not be limited to such. For example, in the fiber depicted in FIG. 1A each of the two components occupies approximately 50 percent of the cross sectional area of the entire fiber; however, a multicomponent fiber wherein one component each occupies 30 percent and the other component occupies 70 percent of the cross sectional area of the fiber would also be suitable. Other variations in the distribution of the individual components of the multicomponent fiber are of course possible and will be evident to one of ordinary skill in the art.

Thermoplastic polymers suitable for use in the multicomponent fibers of the present invention include polyolefins, polyesters, polyamides, polycarbonates and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene; polybutylene, e.g., poly(1-butene) and poly(2-butene); polypentene, e.g., poly(1-pentene) and poly(2-pentene); poly(3-methyl-1-pentene); poly (4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine and the like, as well as blends and copolymers thereof. Suitable polyesters include polyethylene terephthalate, poly-butylene terephthalate, polytetramethylene terephthalate, polycyclohexylene-1,4-dimethylene terephthalate, and isophthalate copolymers thereof, as well as blends thereof.

Selection of polymers for the components of the multicomponent fibers is guided by end-use need, economics, and processability. It should be noted that the above listing of suitable polymers is not exhaustive and other polymers known to one of ordinary skill in the art may be employed, so long as the particular combination of polymers selected to be the components of the multicomponent fiber are capable of being co-spun in a fiber extrusion process, which will depend on such factors as, for example, the relative viscosities of the thermoplastic melts. In addition, it should be noted that the polymers may desirably contain other additives such as processing aids, treatment compositions to impart desired properties to the multicomponent fibers, residual amounts of solvents, pigments or colorants and the like.

Synthetic fibers incorporating energy receptive additives susceptible to dielectric heating are discussed at greater length in co-assigned PCT Pub. No. WO 03/54258 to Workman et al. published Jul. 3, 2003. While the invention is not limited to any particular theory, dielectric heating may be produced by inducing an alternating electromagnetic field which causes dielectrically susceptible molecules to attempt to orient the molecular poles alternatingly or rotate to follow the alternating electromagnetic field. Dielectric heating may be performed using radio frequency energy and microwave energy. Radio frequency "ovens" are commercially available which produce radio frequency energy fields at frequencies of from about 1 megahertz (MHz) to about 80 megahertz, typically from about 10 to about 50 megahertz, and commonly available radio frequency units are available at 13, 27 and 40 MHz. Microwave heating is dielectric heating at still higher frequencies. The predominant frequencies used in microwave heating are 915 and 2450 MHz though other frequencies may be used and particular additives may be found to be receptive at only particular frequencies. Microwave heating is 10 to 100 times higher in frequency than dielectric heating by radio frequency, resulting in a lower voltage requirement if the dielectric loss factor is constant.

Examples of materials that may be suitable energy receptive additives and/or polymers include titanium dioxide, titanium oxide, ferrous sulfate, ferrous oxide, calcium superphosphate, zircon, graphite or high density carbon black, calcium oxide granules, barium sulfate, ruby, silver chloride, silicon, magnesium oxide, alumina, anhydrous sodium carbonate, calcite, mica, and dolomite. Other examples include, but are not limited to, various mixed valent oxides such as magnetite (Fe3O4), nickel oxide (NiO) and such; ferrite, tin oxide, sulfide semiconductors such as FeS2, CuFeS2; silicon carbide; various metal powders such as aluminum, iron and the like; various hydrated salts and other salts, such as calcium chloride dihydrate; diatomaceous earth; adipic acid polymers; aliphatic polyesters e.g. polybutylene succinate and poly(butylene succinate-co-adipate), polymers and copolymers of polylactic acid, polymers such as polyethylene oxide (PEO) and copolymers of PEO, including PEO grafted with polar acrylates; various hygroscopic or water absorbing materials or more generally polymers or copolymers or non-polymers with many sites having hydroxyl (OH) groups; other inorganic microwave absorbers including aluminum hydroxide, zinc oxide, barium titanate and other organic absorbers such as polymers containing ester, aldehyde, ketone, isocyanate, phenol, nitrile, carboxyl, vinylidene chloride, ethylene oxide, methylene oxide, epoxy, amine groups, polypyrroles, polyanilines, polyalkylthiophenes and mixtures thereof.

Processes suitable for producing the crimped multicomponent fibers of the present invention include textile filament production processes, staple fiber production processes, spunbond fiber production processes and meltblown fiber production processes. These multicomponent fiber production processes are known in the art. For example, U.S. Pat. No. 5,382,400 to Pike et al., herein incorporated by reference, discloses a suitable process for producing multicomponent fibers and webs thereof. As another example, PCT publications WO 01/88234 to Haynes et al. and WO 01/88235 to Lake et al. both published 22 Nov. 2001, herein incorporated by reference, disclose processes for producing multicomponent meltblown fibers and webs thereof.

Figure 2:
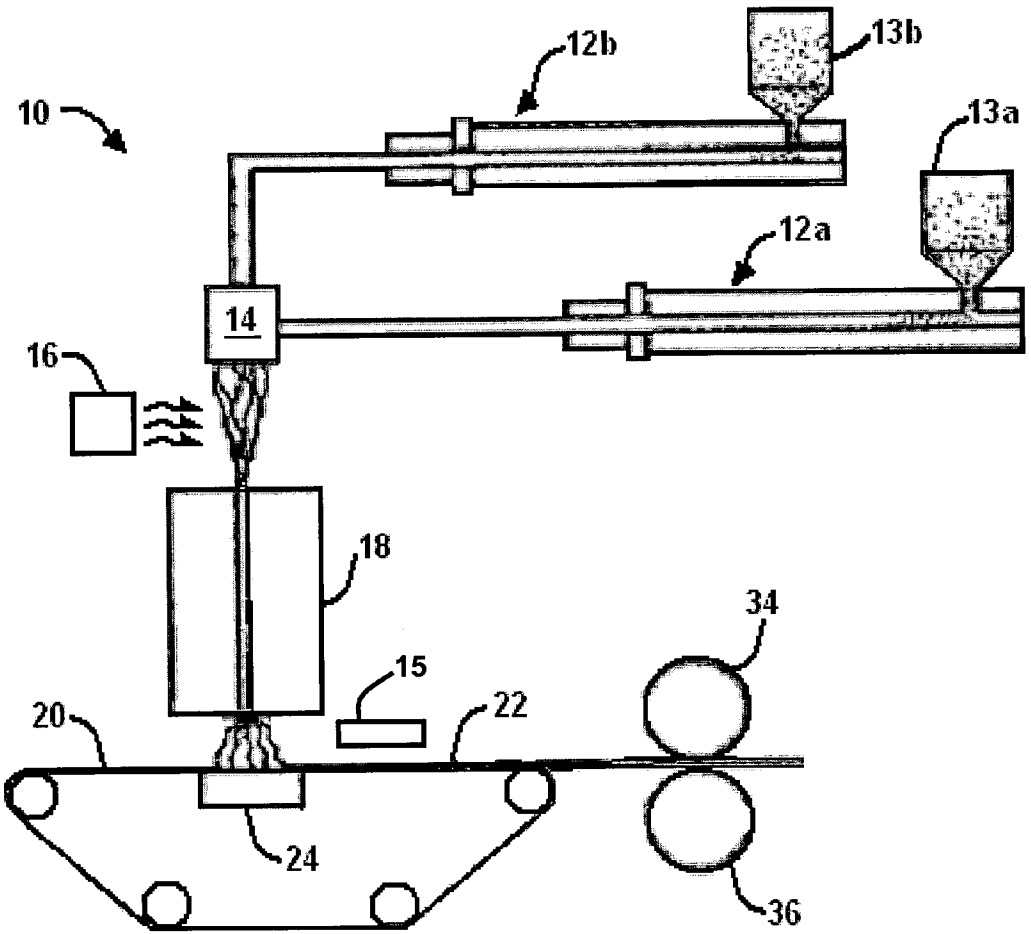
FIG. 2 is a schematic illustration of an exemplary process for producing the crimped multicomponent fibers and multicomponent fiber fabrics of the present invention.

Turning to FIG. 2, there is illustrated an exemplary process for producing the crimped multicomponent fibers of the present invention. A process line 10 is arranged as a spunbond process to produce a nonwoven web of multicomponent fibers containing two polymer components, however it should be understood that the present invention encompasses multicomponent fibers, and fabrics therefrom, which are made with more than two components. The process line 10 includes a pair of extruders 12*a* and 12*b* for separately extruding thermoplastic polymer component A and thermoplastic polymer component B. Thermoplastic polymer component A is fed into the respective extruder 12*a* from a first hopper 13*a* and thermoplastic polymer component B is fed into the respective extruder 12*b* from a second hopper 13*b*. In the practice of the invention, thermoplastic polymer component A comprises a dielectrically susceptible polymer while thermoplastic polymer component B comprises a polymer which has little susceptibility to dielectric energy. As an alternative embodiment, thermoplastic polymer component A may desirably comprise a blend of polymers wherein at least one polymer of the blend is a dielectrically susceptible polymer. In a further embodiment, thermoplastic polymer component A may comprise a polymer which either is susceptible or non-susceptible to dielectric energy and which has had a dielectrically susceptible additive material added to it.

For ease of incorporating a dielectrically susceptible additive material into the component polymer, the additive material may be compounded with a base of the component polymer. By way of example, additive material may be compounded into an additive-component polymer compound at a 50 percent by weight loading level. Then, during the production of the multicomponent fiber, where (for example) this 50 percent additive-polymer compound is added to the virgin component polymer at a rate of 20 kilograms of additive-polymer compound to 80 kilograms of virgin component polymer, the dielectrically susceptible component would then contain 10 percent by weight of the dielectrically susceptible additive material (i.e., the additive containing component is loaded with 10 weight percent of additive). Desirably, where a dielectrically susceptible additive is employed, the additive loading level for the dielectrically susceptible component A will be from about 2 weight percent to about 40 weight percent, and more desirably from about 5 to about 20 weight percent. As will be recognized by those skilled in the art, other additive loading levels may be employed. As will also be recognized by those skilled in the art, other means for incorporating a dielectrically susceptible additive material into the dielectrically susceptible component may be employed, such as for example by coating the additive material onto pellets of the virgin component polymer. Further, it should also be noted that where dielectrically susceptible additives are used, generally a single additive material will be selected to produce the fibers of the invention; however, combinations of additive materials may also be used in the dielectrically susceptible component of the multicomponent fiber.

Returning to FIG. 2, thermoplastic polymer components A and B are fed from the extruders 12*a* and 12*b*, respectively, to a spinneret 14. Spinnerets for extruding multicomponent fibers are well known to those of ordinary skill in the art and thus are not described here in detail. Generally described, the spinneret 14 includes a housing containing a spin pack which includes a plurality of plates stacked one on top of the other with a pattern of openings arranged to create flow paths for directing polymer components A and B separately through the spinneret. An exemplary spin pack for producing multicomponent fibers is described in U.S. Pat. No. 5,989,004 to Cook, the entire contents of which are herein incorporated by reference.

The spinneret 14 has openings or spinning holes called capillaries arranged in one or more rows. Each of the spinning holes receives predetermined amounts of the component extrudates A and B in a predetermined cross-sectional configuration, forming a downwardly extending strand of the multicomponent fibers. In the practice of the invention, the cross-sectional configuration must be a crimpable configuration as described above. The spinneret produces a curtain of the multicomponent fibers. A quench air blower 16 is located adjacent the curtain of fibers extending from the spinneret 14 to quench the fibers. The quench air can be directed from one side of the fiber curtain as shown in FIG. 2, or may be directed from quench air blowers positioned on both sides (not shown) of the fiber curtain. As used herein, the term "quench" simply means reducing the temperature of the fibers using a medium that is cooler than the fibers such as using, for example, ambient temperature air or chilled air.

The multicomponent fibers are then fed through a pneumatic fiber draw unit or aspirator 18 which provides the drawing force to attenuate the fibers, that is, reduce their diameter, and to impart molecular orientation therein and, thus, to increase the strength properties of the fibers. Pneumatic fiber draw units are known in the art, and an exemplary fiber draw unit suitable for the spunbond process is described in U.S. Pat. No. 3,802,817 to Matsuki et al., herein incorporated by reference. Generally described, the fiber draw unit 18 includes an elongate vertical passage through which the fibers are drawn by drawing aspirating air entering from the sides of and flowing downwardly through the passage.

An endless foraminous forming surface 20 is positioned below the fiber draw unit 18 to receive the drawn multicomponent fibers from the outlet opening of the fiber draw unit 18 as a formed web 22 of multicomponent fibers. A vacuum apparatus 24 is positioned below the forming surface 20 to facilitate the proper placement of the fibers. Alternatively, the drawn fibers exiting the fiber drawing unit 18 can be collected for further processing into fibers or yarns.

As stated, one component of the multicomponent fiber will include a dielectrically susceptible polymer and/or a dielectrically susceptible additive material. In order to activate the latent crimp, dielectric energy must be supplied to the multicomponent fibers at some point in the process after the multicomponent fibers have been quenched. The particular energy type or source selected will depend upon the particular susceptible materials (additives and/or polymers) selected. Generally speaking, available energy sources include radio frequency energy fields and microwave energy fields which may be supplied by commercially available radio frequency field sources or microwave ovens. Process line 10 shows energy source 15 located above forming surface 20 and web 22 to supply energy to the multicomponent fibers after they have been collected upon forming surface 20. It should be noted that the location of the energy source may be selected in order to activate crimp at a desirable point in the process. For example, it may be desirable to supply the dielectric energy and thus activate the latent crimp just as the fibers exit the fiber drawing unit, while the fibers are upon the forming surface as shown in FIG. 2, or even at some time after the fibers have been formed into a web and have exited the process. As a specific example, it may be desirable for ease of transportation and handling to have a web material wherein the fibers are in an uncrimped state. In this instance, one may form the fibers into a web material, wind the material on a roll, and transport the material roll to a product converting operation all prior to subjecting the fibers to the crimp activating energy, and only activate the latent crimp during the product converting operation.

As shown in FIG. 2, the formed web 22 is then carried on the foraminous surface 20 to calender bonding rollers 34, 36. Although calender bonding is shown in FIG. 2, any nonwoven fabric bonding process can be used to bond the formed web, including calender bonding as mentioned, pattern bonding, flat calender bonding, ultrasonic bonding, through-air bonding, adhesive bonding, and entanglement bonding such as hydroentangling or mechanical needling processes. As mentioned, a pattern bonding process is shown which employs pattern bonding roll pairs 34 and 36 for effecting bond points at limited areas of the web by passing the web through the nip formed by the bonding rolls 34 and 36. One or both of the roll pair have a pattern of land areas and depressions on the surface, which effects the bond points, and either or both may be heated to an appropriate temperature. The temperature of the bonding rolls and the nip pressure are selected so as to effect bonded regions without having undesirable accompanying side effects such as excessive shrinkage, excessive fabric stiffness and web degradation.

Other exemplary bonding processes suitable for bonding the multicomponent fiber web include through-air bonding processes. A typical through-air bonding process applies a flow of heated air onto the web to effect inter-fiber bonds, and the bonding process is particularly useful for nonwoven webs containing multicomponent fibers having at least one high melting point component polymer and one low melting point component polymer such that the low melting component can be heat activated to form inter-fiber bonds while the high melting component retains the physical integrity of the webs. The heated air is applied to heat the web to a temperature above the softening point of the low melting thermoplastic polymer component of the web but at a temperature below the softening point of the higher melting polymer component of the fibers. Through-air bonding processes generally require significantly less compacting pressure than calender bonding processes and therefore are highly suitable for retaining the loft of as-formed crimped fiber webs, and are thus capable of producing a more lofty bonded fabric. Lofty nonwoven fabrics are highly suitable for use in personal care absorbent articles as, for example, a liquid acquisition and distribution or "surge management" layer.

While not shown here, various additional potential processing and/or finishing steps known in the art such as aperturing, slitting, stretching, treating, or further lamination with other films or other nonwoven layers, may be performed without departing from the spirit and scope of the invention. Examples of web finishing treatments include electret treatment to induce a permanent electrostatic charge in the web, or antistatic treatments. Another example of web treatment includes treatment to impart wettability or hydrophilicity to a web comprising hydrophobic thermoplastic material. Wettability treatment additives may be incorporated into the polymer melt as an internal treatment, or may be added topically at some point following fiber or web formation. In addition, various processing steps as have been described herein may be altered without departing from the spirit and scope of the invention. As an example, mechanical driven draw rollers as are known in the art may be substituted for the pneumatic drawing and attenuating step described above. Mechanical drawing rollers may be particularly desirable where the multicomponent fibers of the invention will be further processed as yarns or cut into staple fiber lengths rather than being immediately formed into a nonwoven web material as was depicted above in FIG. 2.

As another embodiment of the present invention the multicomponent fibers may be formed into a web which is used as a laminate that contains at least one additional layer of another woven or nonwoven fabric, or a film, or foam. The additional layer for the laminate is selected to impart additional and/or complementary properties, such as liquid absorbency, or liquid barrier and/or microbe barrier properties. The layers of the laminate can be bonded to form a unitary structure by a bonding process known in the art to be suitable for laminate structures, such as thermal, ultrasonic or adhesive bonding processes. An exemplary laminate structure is disclosed in U.S. Pat. No. 4,041,203 to Brock et al., herein incorporated in its entirety by reference, which discloses a pattern bonded laminate of at least one fiber nonwoven web, e.g., spunbond fiber web, and at least one microfiber nonwoven web, e.g., meltblown web. Alternatively, a breathable film can be laminated to the multicomponent fiber web to provide a breathable barrier laminate material. As yet another embodiment of the present invention, the multicomponent fiber web can be laminated to a non-breathable film to provide a high barrier laminate material. These laminate structures are highly suitable for various uses including various skin-contacting applications, such as protective garments, covers for diapers, adult care products, training pants and sanitary napkins, various drapes, and the like. The latent crimp may be activated either prior to or following lamination of the multicomponent fiber web to the additional layer or layers.

As still another embodiment of the present invention the multicomponent fibers may be produced as described above and then be cut into staple length fibers prior to being formed into a nonwoven web. Various methods of dry laying and wet laying staple length fibers into a nonwoven web are known in the art. As an example, the multicomponent fibers may be formed into a nonwoven web by carding or airlaying processes, either alone or in combination with other or secondary fiber types such as monocomponent or multicomponent thermoplastic fibers such as thermoplastic binder fibers, and/or with cellulosic fibers, and/or in combination with superabsorbent materials. The crimp activation energy may be supplied to the multicomponent fibers either before they are carded or airlaid into the nonwoven web or may be supplied after web formation.

As an example of the foregoing, the multicomponent fibers of the invention may be combined with cellulosic fibers such as wood pulp fluff fibers as are known in the art and airlaid into a composite absorbent material, either with or without additional binder materials such as thermoplastic binder fibers. Superabsorbent materials such as superabsorbent particles may also be beneficially incorporated into the airlaying process and thus incorporated into the composite absorbent material to produce a composite absorbent material having higher liquid retention capacity. Generally, superabsorbent materials include water-swellable, generally water insoluble materials capable of absorbing at least about 10 times their weight in water, and more specifically, as much as 20, 50, 100 times, or even up to 300 times or more their weight in water (or other dispersion medium). Superabsorbent materials may be formed from organic material which may include natural materials such as agar, pectin, and guar gum, as well as synthetic materials such as synthetic hydrogel polymers. Synthetic hydrogel polymers include, for example, carboxymethylcellulose, alkali metal salts of polyacrylic acid and its copolymers, polyacrylamides, polyvinyl alcohol, ethylene maleic anhydride copolymers, polyvinyl ethers, hydroxypropylcellulose, hydroxypropyl acrylate, polyvinyl morpholinone, polymers and copolymers of vinyl sulfonic acid, polyacrylates, polyacrylamides, polyvinyl pyridine, and the like. Suitable superabsorbent materials are available from various commercial vendors, such as the Dow Chemical Company, Stockhausen Inc., and Chemtall Inc.

The thus-formed absorbent composite material may then be bonded together by through-air bonding or hot calendaring or other suitable method to form a stabilized absorbent composite material which is highly suitable as an absorbent layer or absorbent core material for personal care absorbent articles such as diapers, training pants, disposable swimwear, incontinence garments and pads, feminine care sanitary napkins.

Figure 3:
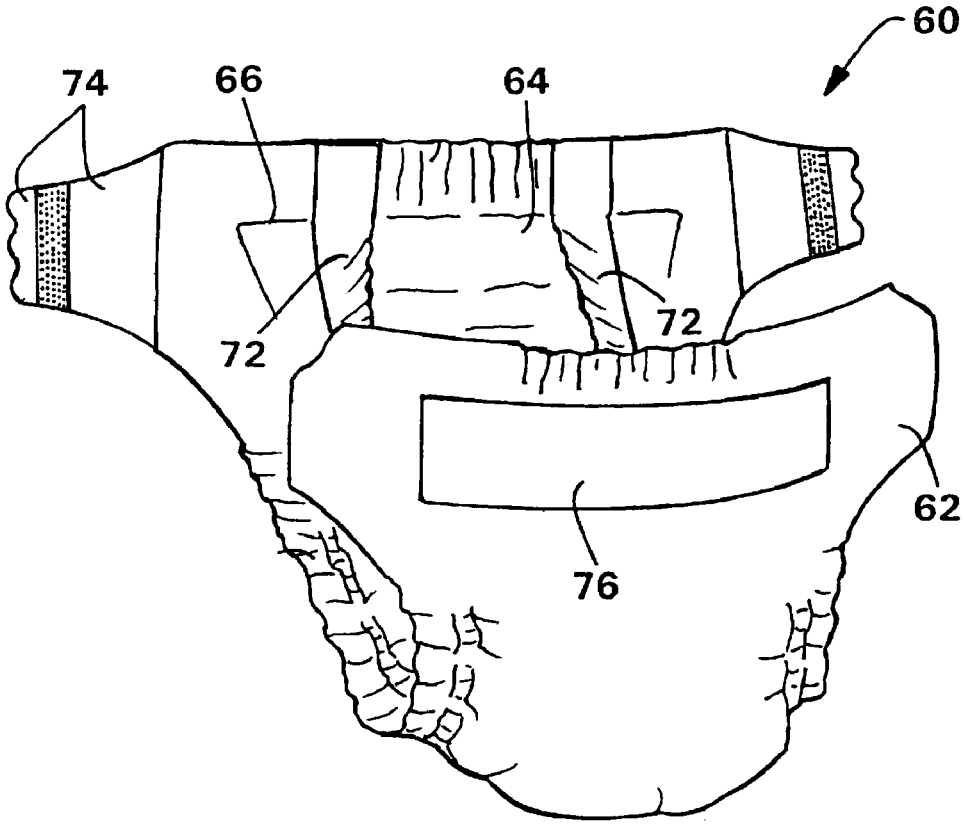
FIG. 3 is a perspective view of a disposable diaper comprising the crimped multicomponent fibers and multicomponent fiber fabrics of the invention.

Turning to FIG. 3 there is shown an exemplary personal care article such as the diaper 60. Diaper 60, as is typical for most personal care absorbent articles, includes a liquid permeable body side liner 64, i.e., a body-facing or inner side, and a liquid impermeable outer cover 62, i.e., a non-body facing or outer side. Various woven or nonwoven fabrics can be used for body side liner 64 such as a spunbond nonwoven web of polyolefin fibers, or a bonded carded web of natural and/or synthetic fibers. Liner 64 may also beneficially be a spunbonded web or carded web material comprising the multicomponent fibers of invention. Outer cover 62 is formed of a thin liquid barrier material such as for example a spunbond-meltblown layer, spunbond-meltblown-spunbond layer, or a thermoplastic polymer film layer. A polymer film outer cover may be embossed and/or matte finished to provide a more aesthetically pleasing appearance, or may be a laminate formed of a thermoplastic film and a woven or nonwoven fabric to provide a more aesthetically pleasing feel and sound or more "cloth-like" characteristics. Where outer cover 62 is a film/nonwoven laminate material, the nonwoven layer may advantageously comprise the fibers of the invention as a spunbonded or carded web layer. Outer cover 62 may optionally be composed of a "breathable" material that is permeable to vapors or gas yet substantially impermeable to liquid, such as is known in the art. Examples of outer cover materials include but are not limited to those disclosed in U.S. Pat. No. 6,309,736 to McCormack et al., incorporated herein by reference in its entirety.

Disposed between liner 64 and outer cover 62 is an absorbent core 66 formed, for example, of a blend of hydrophilic cellulosic wood pulp fluff fibers and highly absorbent gelling particles (e.g., superabsorbent material). Absorbent core 66 may further comprise the crimped multicomponent fibers of the invention and/or other thermoplastic binder fibers as has been described herein. Diaper 60 may further include optional containment flaps 72 made from or attached to body side liner 64. Suitable constructions and arrangements for such containment flaps are described, for example, in U.S. Pat. No. 4,704,116 to Enloe, incorporated herein by reference in its entirety. Still further, the diaper 60 can optionally include additional elements known to those skilled in the art, including but not limited to, elasticized leg cuffs, elastic waist band, and so forth.

To secure the diaper 60 about the wearer, the diaper will have some type of fastening means attached thereto. As shown in FIG. 3, the fastening means is a hook and loop fastening system including hook elements 74 attached to the inner and/or outer surface of outer cover 62 in the back waistband region of diaper 60 and one or more loop elements or patches 76 attached to the outer surface of outer cover 62 in the front waistband region of diaper 60. The loop material for loop patch 76 can be a woven, nonwoven or knitted loop material and may be secured to outer cover 62 of diaper 60 by known attachment means, including but not limited to adhesives, thermal bonding, ultrasonic bonding, or a combination of such means. Where the loop patch 76 loop material is a nonwoven material, it may be a nonwoven web comprising the crimped multicomponent fibers of the invention. As an alternative embodiment, a nonwoven loop material may cover all of, or substantially all of, the outer surface of outer cover 62. An example of this would be an outer cover material constructed of a laminate of thermoplastic film and nonwoven web material wherein the nonwoven web comprises the crimped multicomponent fibers of the invention.

EXAMPLE

Figure 1B:
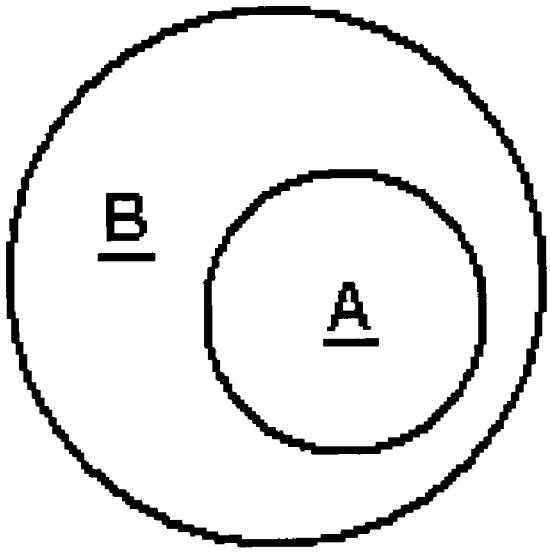

Crimped multicomponent fibers of the invention were produced in an eccentric sheath-and-core cross-sectional configuration, such as is schematically depicted in FIG. 1B, wherein the eccentric core was the dielectrically susceptible component of the multicomponent fibers. The sheath component, which occupied approximately 65% of the multicomponent fiber cross-sectional area, contained about 95% by weight linear low density polyethylene (LLDPE) and about 5% by weight of titanium dioxide white pigment. The eccentric core component of the fiber occupied approximately 35% of the fiber cross section and contained about 90% by weight polypropylene (PP) and about 10% by weight carbon black as a dielectrically susceptible additive material. The multicomponent fibers were extruded, quenched and drawn using a spunbond-type process such as was described with reference to FIG. 2 except that individual fibers were collected rather than gathering the fibers into a web and bonding. The fibers thus produced were approximately 18 microns in diameter and did not exhibit any noticeable level of crimping.

Figure 4A:
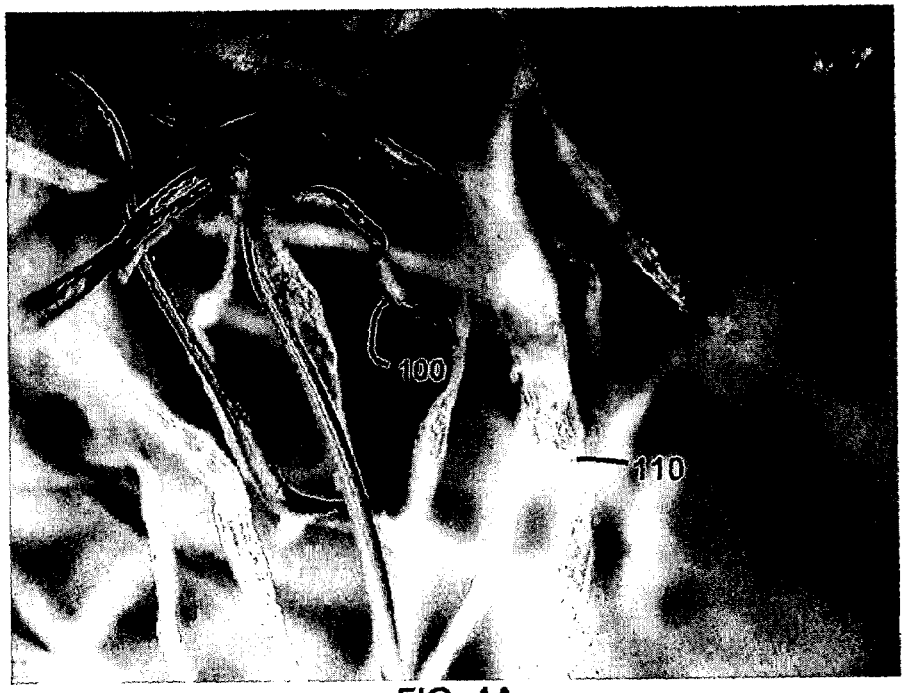
FIGS. 4A–4D are photomicrographs of crimped multicomponent fibers of the invention.
Figure 4B:
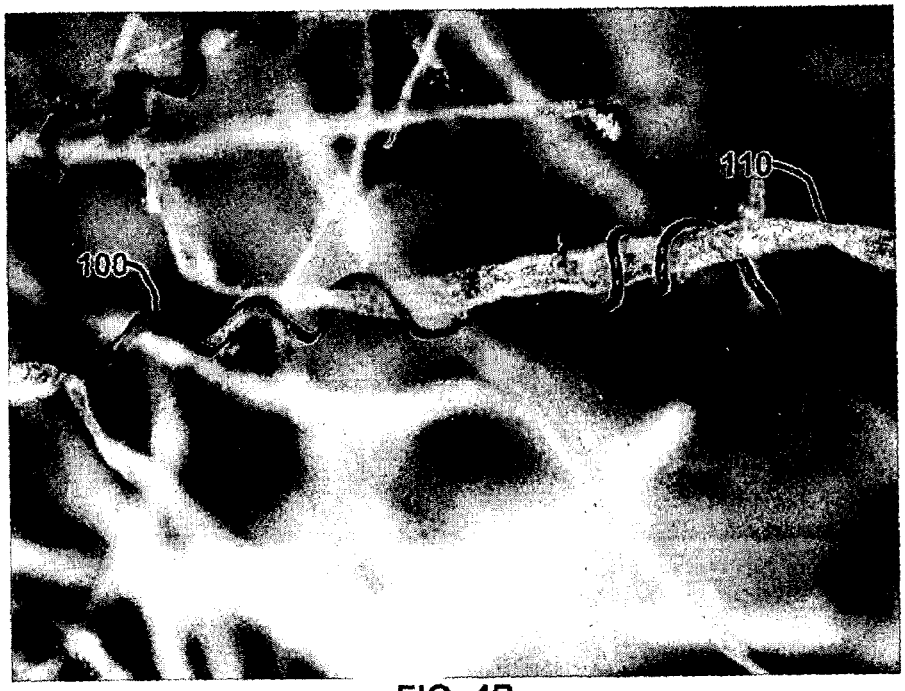
Figure 4C:
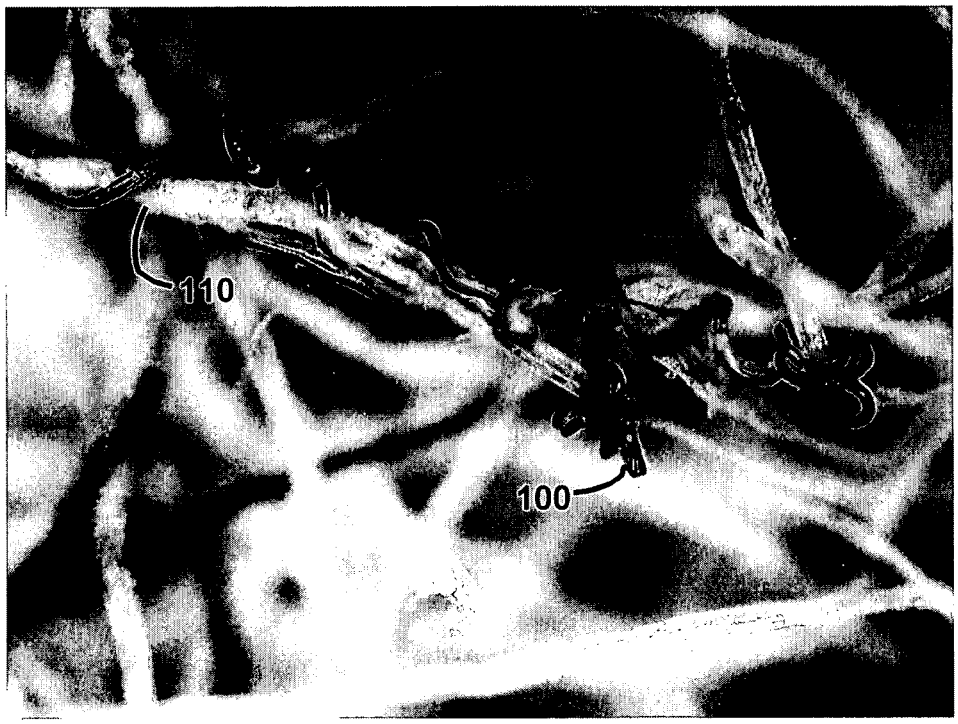
Figure 4D:
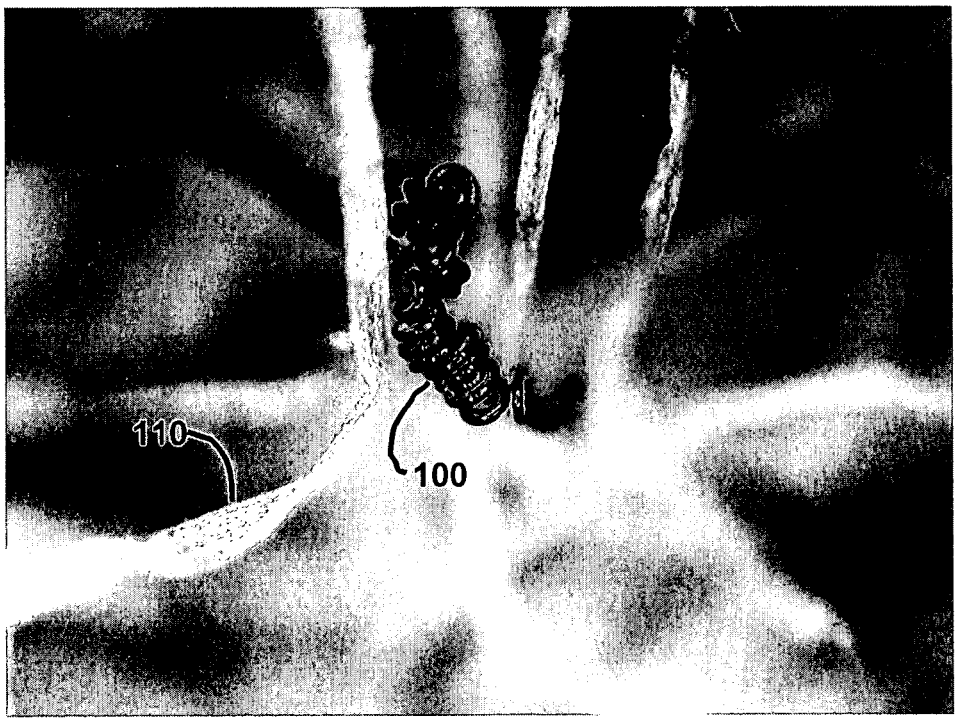

The multicomponent fibers were then placed in a matrix of pulp fluff fibers and subjected to microwave energy at 2450 megahertz (MHz) at approximately 4 kilowatts which caused heating of the dielectrically susceptible eccentric core, allowing the core component to soften and relax and thereby activate the latent crimp. As can be seen in FIG. 4A and especially in FIGS. 4B, 4C and 4D, the resulting multicomponent fibers 100 exhibit a high degree of crimping or curling of the fibers. In some cases, the multicomponent fibers are coiled into a tight spring-like configuration as in FIG. 4D. In other cases and as can readily be seen in FIG. 4B and FIG. 4C, some of the multicomponent fibers wrapped themselves around a portion of the length of some of the matrix pulp fibers 110, which may assist in binding the matrix together.

While various patents have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

We claim:

1. A crimped thermoplastic multicomponent fiber comprising a first thermoplastic component and a second thermoplastic component arranged in a crimpable cross-sectional configuration, wherein the first thermoplastic component includes at least about 5 percent by weight of a dielectrically susceptible additive material.

2. The crimped thermoplastic multicomponent fiber of claim 1 wherein the crimpable cross-sectional configuration is a side-by-side configuration or an eccentric sheath-core configuration.

3. The crimped thermoplastic multicomponent fiber of claim 2 wherein the first component comprises a dielectrically susceptible copolyester.

4. The crimped thermoplastic multicomponent fiber of claim 2 wherein the first component comprises a polyolefin thermoplastic polymer and wherein said dielectrically susceptible additive material is carbon black.

5. The crimped thermoplastic multicomponent fiber of claim 4 wherein the first component comprises from about 60% by weight to about 95% by weight polypropylene and from about 5% by weight to about 40% by weight carbon black.

6. The crimped thermoplastic multicomponent fiber of claim 5 wherein the second component comprises polyethylene.

* * * * *